US009777996B2

(12) United States Patent
Spuhr

(10) Patent No.: US 9,777,996 B2
(45) Date of Patent: Oct. 3, 2017

(54) MOUNTING ASSEMBLY

(71) Applicant: Spuhr i Dalby AB, Löddeköpinge (SE)

(72) Inventor: Håkan Spuhr, Dalby (SE)

(73) Assignee: SPUHR I DALBY AB, Loddekopinge (SE)

( * ) Notice: Subject to any disclaimer, the term of this patent is extended or adjusted under 35 U.S.C. 154(b) by 198 days.

(21) Appl. No.: 14/633,274

(22) Filed: Feb. 27, 2015

(65) Prior Publication Data

US 2016/0252329 A1 Sep. 1, 2016

(51) Int. Cl.
*F41G 1/387* (2006.01)
*F41G 11/00* (2006.01)

(52) U.S. Cl.
CPC ..... *F41G 11/003* (2013.01)

(58) Field of Classification Search
USPC ..... 42/90, 124
See application file for complete search history.

(56) References Cited

U.S. PATENT DOCUMENTS

| | | | |
|---|---|---|---|
| 8,112,933 | B1 | 2/2012 | Swan |
| 8,151,509 | B2 | 4/2012 | Rozitis et al. |
| 8,407,923 | B2 | 4/2013 | Ash, Jr. et al. |
| 8,683,732 | B2 | 4/2014 | Joplin |
| 8,701,331 | B2 | 4/2014 | Schneider et al. |
| 8,733,011 | B2 | 5/2014 | Spuhr |
| 8,898,949 | B1 | 12/2014 | Greenwood |
| 2011/0271578 | A1 | 11/2011 | Karagias |
| 2013/0318852 | A1 | 12/2013 | Teetzel et al. |
| 2014/0109457 | A1 | 4/2014 | Speroni |

FOREIGN PATENT DOCUMENTS

| | | |
|---|---|---|
| DE | 83 33 875 | 5/1984 |
| DE | 84 16 691 | 10/1984 |
| WO | 2011/031203 | 3/2011 |
| WO | 2011/085295 | 7/2011 |

OTHER PUBLICATIONS

European Search Report dated Jun. 30, 2016 for corresponding European application No. 16157665.7.

*Primary Examiner* — J Woodrow Eldred
(74) *Attorney, Agent, or Firm* — Renner, Otto, Boisselle & Sklar, LLP.

(57) ABSTRACT

A mounting assembly which may be releasably mounted on a standard mounting rail, where said rail includes a base plate and evenly spaced upwardly extending rail projections with evenly spaced transverse slots there between, each rail projection having an angulated upper side surface and an angulated lower side surface, said mounting assembly comprising:

a first rail engaging surface and a second rail engaging surface, said first rail engaging surface and said second rail engaging surface facing said angulated lower side surface, when mounted on the rail, a third rail engaging surface and a fourth rail engaging surface, said third rail engaging surface and said fourth rail engaging surface facing said angulated upper side surface, when mounted on the rail, wherein at least said third rail engaging surface and said fourth rail engaging surface are formed with alternating flat surfaces and indentation surfaces, each indentation surface having a width extending a width of each of said transverse slots, and each flat surface having a width smaller than a width of each rail projection.

5 Claims, 2 Drawing Sheets

MOUNTING ASSEMBLY

TECHNICAL FIELD

The present invention relates generally to a mounting assembly which may be releasably mounted on a standard mounting platform, such as a Picatinny-type rail such as MIL-STD-1913 or the successor STANAG 4694.

This type of rail or rail base is an elongated metal structure that is machined to define a number of evenly spaced upwardly extending rail projections with evenly spaced transverse slots there between to provide for selective location of an accessory on a firearm. The sides of each rail projection have parallel angulated contact surfaces that form the "mounting rails" of base. Each of the mounting projections has a flat top surface mounting surface and opposite transverse edges that are beveled to form a "dove tail" cross sectional profile with a pair of oppositely angulated upper side surfaces, and a pair of oppositely angulated lower side surfaces. Both angulated upper side surfaces and angulated lower side surfaces and are oriented at 45° angles with respect to the horizontal plane of top surface.

PRIOR ART

The increasing complexity of combat has generated a need for weapons with increased accuracy and which are capable of supporting a variety of accessories. These accessories include, for example, scopes, sights, laser spotters, and flashlights. Consequently, a variety of mounts or mounting systems for rifles and other firearms have been developed. These mounting systems most commonly utilize Picatinny-type rails or rail bases, which are affixed to the barrel or stock of the weapon. Accessories are mounted onto the rails by a number of different methods.

A prior art mounting assembly as disclosed in U.S. Pat. No. 8,701,331 includes a base having at least a first rail-engaging surface and a clamp rotatably mounted to the base by a pivot and having at least a second rail-engaging surface. The clamp pivots with respect to the base to move the second rail-engaging surface between an engaged position where the assembly engages a rail between the first and second rail-engaging surfaces and a disengaged position where the assembly disengages a rail. An embodiment of the mounting assembly also includes a locking mechanism having a locked position that locks the clamp in its engaged position.

U.S. Pat. No. 8,733,011 discloses a sight mount comprising a base plate arranged to be fitted on a firearm accessory rail. The sight mount is fitted with clamping screws that are used to attach a clamp rail to the firearm accessory rail. The clamp rail cooperates with a base plate at an opposite side of the accessory rail to hold the sight mount in position on the accessory rail.

When mounting for example riflescopes and various sighting systems the repeatability is crucial for success, in other cases as with flashlights or various grips the repeatability is much less crucial. The current standard rail STANAG 4694 NATO Accessory Rail has a maximum tolerance of 0.2 mm chamfer/break on the corners of the rail. Since this is a maximum value it is also common not have any broken corners at all. As a result there could be various problems such as sharp chips standing up from the corners if something hard hits the rail. This is likely to happen because such items regardless of firearms or various optical devices usually are used in harsh environment in various military theaters. Contact surfaces of clamp rails, base plates and similar connecting means are flat and even. Any angular deviation between mating contact surfaces of either the mount or the rail base results in a less than optimal engagement and can result in alignment and cant problems.

Most rails are made in aluminum and should be surface treated, such as by Type 3 hardcoat anodizing to various military standards. This treatment process provides a thicker and harder surface. However, it also builds on corners of the material. As a result a perfectly shaped 90-degree edge will after treatment present an extended edge. Such an outstanding edge also may result in alignment and cant problems.

SUMMARY OF THE INVENTION

In this regard, the present invention provides for an improved mounting assembly that is configured to be releasably attached to a standard mounting platform with high repeatability and overcoming the drawbacks of prior art mounting assemblies. In accordance with the invention indentations are formed on selected surfaces of in the mounting assembly. The indentations formed are capable of receiving outstanding sharp edges and chips on the rail.

In various embodiments indentations are formed at those sections of the mounting assembly that will be arranged opposite to spaced transverse slots between dovetail segments of the rail but extending partly over those lower angled surfaces of the rail that will be in contact with the mounting assembly. The mounting assembly in accordance with the invention can be used on various kinds of weapons and on other equipment using standard accessory rails. It is capable of supporting a variety of accessories. These accessories include, for example, scopes, sights, laser spotters, and flashlights and various other types of accessories.

REFERENCE NUMBERS

| | |
|---|---|
| 10 | mounting assembly |
| 11 | |
| 12 | central rib |
| 13 | |
| 14 | central section |
| 15 | |
| 16 | side sections |
| 17 | first rail-engaging surfaces |
| 18 | flat surfaces |
| 19 | second rail-engaging surface |
| 20 | indentation surfaces |
| 21 | |
| 22 | base plate |
| 23 | |
| 24 | front mounting ring half |
| 25 | |
| 26 | rear mounting ring half |
| 27 | clamp |
| 28 | standard rail |
| 29 | clamping screws |
| 30 | rectangular base plate |
| 31 | |
| 32 | rail projections |
| 33 | third rail-engaging surface |
| 34 | transverse slots |
| 35 | fourth rail-engaging surface |
| 36 | flat top surface mounting surface |
| 37 | fifth rail-engaging surface |
| 38 | angulated upper side surfaces |
| 39 | |
| 40 | angulated lower side surface |
| 41 | |
| 42 | circle |
| 43 | |
| 44 | circles with dashed lines |
| 45 | |

-continued

| REFERENCE NUMBERS | |
|---|---|
| 46 | chips or burrs |
| 47 | |
| 48 | |
| w | standard rail width |
| s | width of the slots of rail |
| b | width of indentation surface 20 |
| m | length of central section of flat surface |
| e | length of end sections of indentation surfaces 20 have a f |
| c | distance between centres of transverse slots |

BRIEF DESCRIPTION OF THE DRAWINGS

In order that the manner in which the above recited and other advantages and objects of the invention are obtained will be readily understood, a more particular description of the invention briefly described above will be rendered by reference to specific embodiments thereof which are illustrated in the appended drawings.

Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
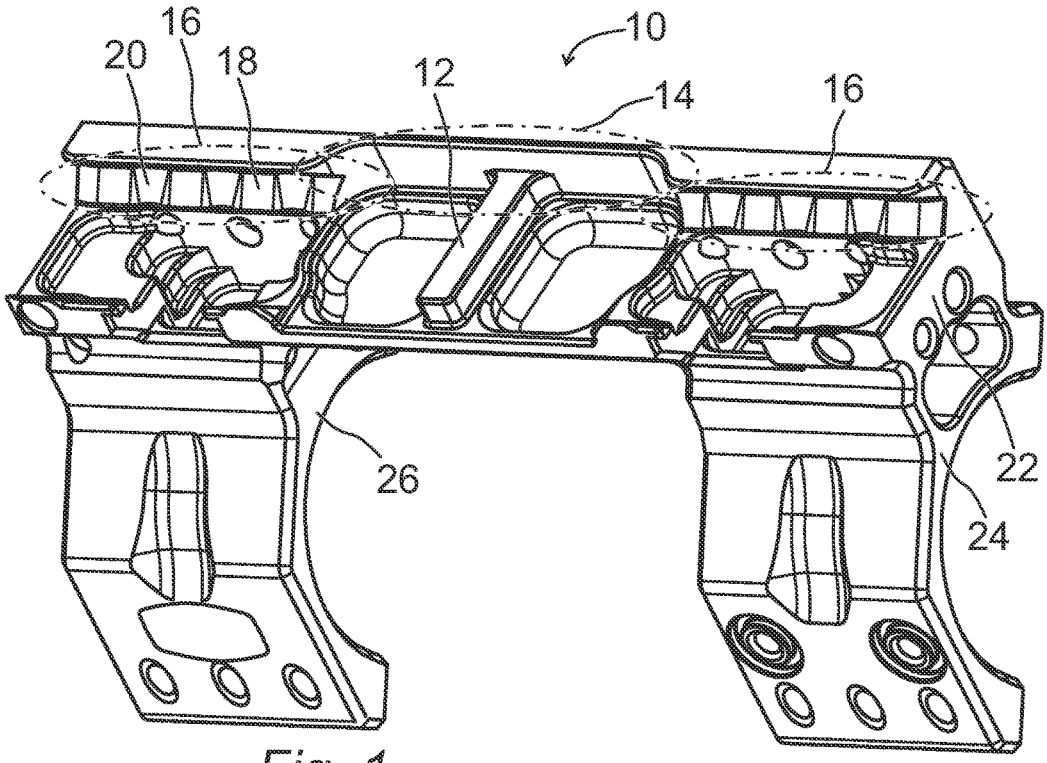
FIG. 1 is a schematic perspective view from below of one embodiment of a partly cut mounting assembly in accordance with the invention.
Figure 4:
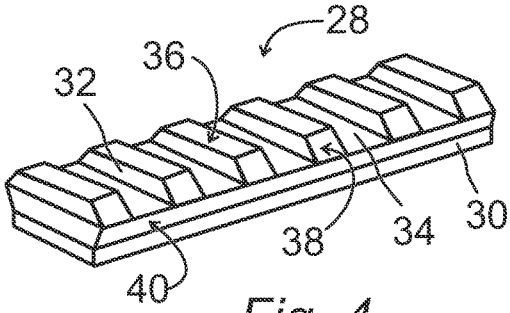
FIG. 4 is a schematic perspective view of a standard rail for accessories.
Figure 6:
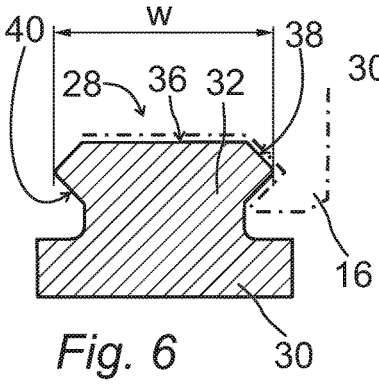
FIG. 6 is a cross-section view through line VI-VI of FIG. 5.

In FIG. 1 a mounting assembly 10 is shown upside down and cut open to show surfaces that will face a rail, c.f. FIG. 4 and FIG. 6. A central rib 12 will be lowered into and received in a transverse slot of the rail and fix the mounting assembly 10 in the longitudinal direction of the rail when the mounting assembly is attached to a rail. As shown in FIG. 1 an opening is formed in side walls of a central section 14 of the mounting assembly 10 around the central rib 12. As a result there will be no surfaces of the mounting assembly 10 abutting the rail in this area.

Figure 8:
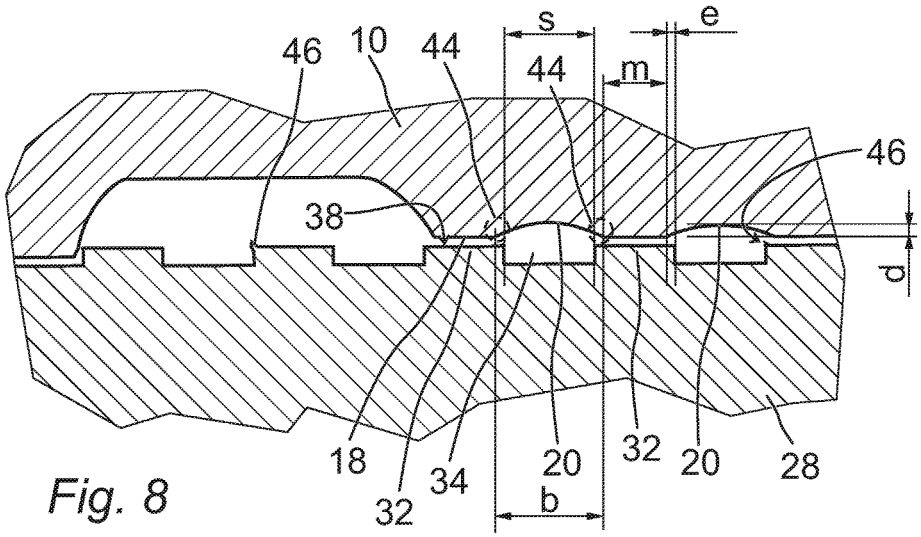
FIG. 8 is a schematic cross-section of a part of the mounting assembly of FIG. 4 as indicated by a circle.

Side sections 16 on either side of said central section 14 are formed with alternating flat surfaces 18 and indentation surfaces 20. The flat surfaces 18 will face evenly spaced upwardly extending rail projections of the rail while the indentation surfaces 20 will face evenly spaced transverse slots there between. End sections of the indentation surfaces 20 extend partly over the upwardly extending rail projections, c.f. FIG. 8, when mounted on a rail. The mounting assembly 10 comprises also clamping screws (not shown).

The embodiment of the mounting assembly 10 shown in FIG. 1 is designed to hold a sight. Other embodiments of the mounting assembly 10 are designed for other accessories such as gun slings, rifle scopes, rifle laser target illuminators, flashlights, spent shell collectors, and the like. The mounting assembly 10 comprises a base plate 22 a front mounting ring half 24 and a rear mounting ring half 26. The mounting assembly 10 also comprises a further front mounting ring half (not shown) and a further rear mounting ring half (not shown) interacting with the front mounting ring half 24 and the rear mounting ring half 26 to form there between an open circular space that will receive a sight (not shown).

Figure 2:
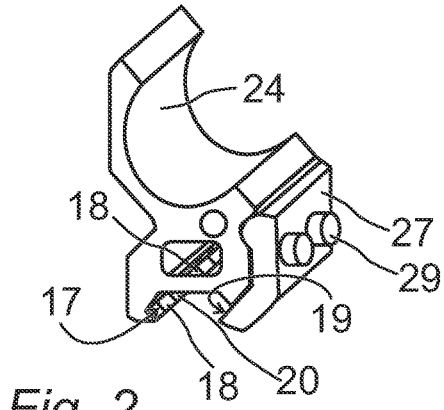
FIG. 2 is a schematic perspective view of a section of the mounting assembly of FIG. 1.

FIG. 2 is a cut off section of the front mounting ring half showing a clamp 27 used for attaching the mounting assembly 10 to a rail. In various embodiments a quick clamping assembly that provides adjustable spring tension to control the clamping force exerted against the rail replaces the clamp. Two clamping screws 29 are used to maintain the clamp 27 in position. Said side sections 16 comprise a first rail-engaging surface 17 and a second rail-engaging surface 19, and also third and fourth rail-engaging surfaces, c.f FIG. 3. In the embodiment shown in FIG. 2 all rail-engaging surfaces are formed with alternating flat surfaces 18 and indentation surfaces 20.

Figure 3:
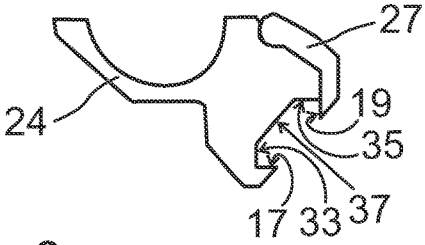
FIG. 3 is side view of the section in FIG. 2.
Figure 5:
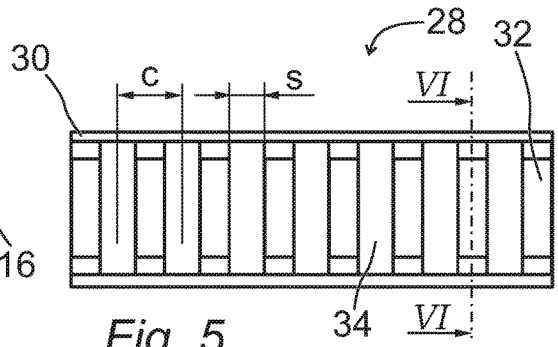
FIG. 5 is a top view of a standard rail for accessories.

FIG. 3 further illustrates that a mounting assembly 10 in accordance with the invention has five surfaces that can be in engagement with a standard rail as shown in FIG. 4-FIG. 6. Depending on expected forces acting on the mounting assembly 10 and other conditions the mounting assembly 10 is designed so that three or more of these surfaces are actually are engaging the rail. First rail-engaging surface 17 and second rail-engaging surface 19 can engage an angulated lower mounting surface 40 of said rail 28. A third rail-engaging surface 33 and fourth rail-engaging surface 35 are designed to engage oppositely angulated upper mounting surfaces 38. It should be noted that angulated lower mounting surface 40 is flat in accordance with present standards. A fifth rail-engaging surface 37 will face a flat upper side of rail projections 32. At least third rail-engaging surface 33 and fourth rail-engaging surface 35 are formed with alternating flat surfaces 18 and indentation surfaces 20.

FIG. 4-FIG. 6 show the standard rail 28. It is formed with a rectangular base plate 30 and a number of evenly spaced upwardly extending rail projections 32 with evenly spaced transverse slots 34 there between to provide for selective location of an accessory. Each of the rail projections is formed with flat top surface mounting surface 36 and opposite transverse edges that are beveled to form a "dove tail" cross sectional profile with oppositely angulated upper mounting surfaces 38, and oppositely angulated lower mounting surfaces 40. The flat top surface mounting surface 36 will face and in embodiments engage said fifth rail-engaging surface 37. Both angulated upper mounting surfaces and angulated lower mounting surfaces and are oriented at 45° angles with respect to the horizontal plane of top surface mounting surface 36. The mounting projections of a STANAG 4694 standard rail has a width w=21.2 mm. The distance between centers of transverse slots is c=10 mm, and the width of the slots s=5.35 mm.

Figure 7:
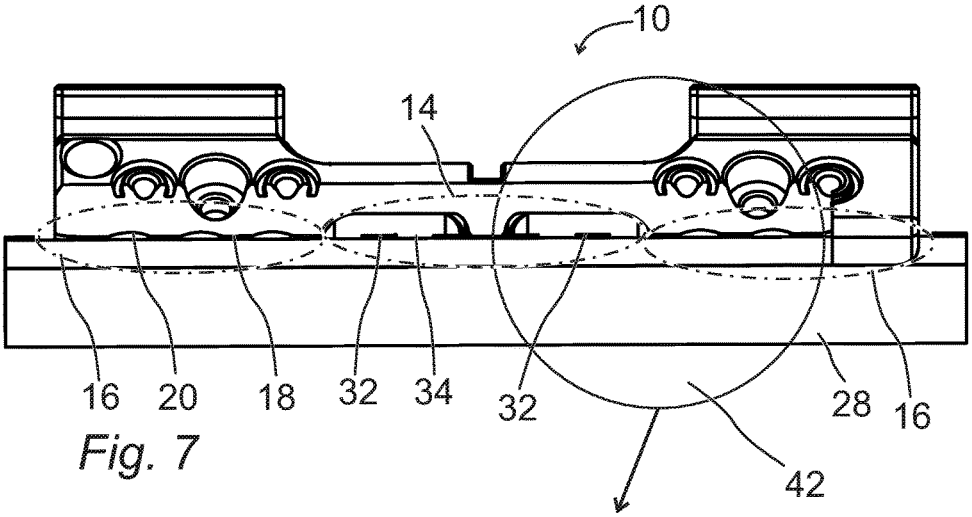
FIG. 7 is a side view of the mounting assembly of FIG. 1 mounted on a rail in an upside down position.

In FIG. 7 a mounting assembly 10 is shown in engagement with a standard rail 28. Side sections 16 on either side of said central section 14 are formed with alternating flat surfaces 18 and indentation surfaces 20. The flat surfaces 18 will face evenly spaced and upwardly extending rail projections 32 of the rail while the indentation surfaces 20 will face evenly spaced transverse slots 34 there between. End sections of the indentation surfaces 20 extend over the upwardly extending rail projections, c.f. FIG. 8.

FIG. 8 is an enlarged part corresponding to circle 42 of mounting assembly 10 and rail 28 shown in FIG. 7. The positions of mounting assembly 10 and rail 28 shown in FIG. 8 correspond to a position where the mounting assembly 10 is close to a final position abutting rail 28. In accordance with the invention the mounting assembly 10 is formed with alternating flat surfaces 18 and indentation surfaces 20. The flat surfaces 18 will face evenly spaced upwardly extending rail projections 32 of rail 28 while the indentation surfaces 20 will face evenly spaced transverse slots 34 there between. The area corresponding to the indentation surfaces normally will not contact angulated upper mounting surfaces 38 of the rail because the indentation surfaces 20 will be opposite transverse slots 34. As a result the forming of indentations will not decrease any function of the mounting assembly.

As shown in circles with dashed lines 44 of FIG. 8 end sections of the indentation surfaces 20 extend partly over the upwardly extending rail projections 32. Each indentation surface 20 has a width b. Width b is larger than width s of the slots in the rail and is at least about 6 mm. In various embodiments width b is between 5.95 mm and 7.15. As a result only a central section having the length m of flat surfaces 18 will actually engage corresponding angulated upper mounting surfaces 38 of rail 28. The end sections of indentation surfaces 20 have a length e.

Length m is a substantial part of width of rail projections. In various embodiments length m is between 3 mm and 4 mm and approximately 3.5 mm. Length e is between 0.3 mm and 0.9 mm. Length e can be different at different sides of an indentation surface. The indentation surfaces 20 have a width b and a depth or indentation d that is sufficient to receive chips or burrs 46. A suitable depth d at deepest position is about 1.5 mm. The dimensions of the indentations may depend on materials used and expected external conditions.

While certain illustrative embodiments of the invention have been described in particularity, it will be understood that various other modifications will be readily apparent to those skilled in the art without departing from the scope and spirit of the invention. Accordingly, it is not intended that the scope of the claims appended hereto be limited to the description set forth herein but rather that the claims be construed as encompassing all equivalents of the present invention which are apparent to those skilled in the art to which the invention pertains.

What is claimed is:

1. A mounting assembly which may be releasably mounted on a standard mounting rail, where said rail includes a base plate and evenly spaced upwardly extending rail projections with evenly spaced transverse slots there between, each rail projection having an angulated upper side surface and an angulated lower side surface, said mounting assembly comprising:

a rib arranged to be received in one of said transverse slots to fix said mounting assembly in a longitudinal direction of said standard mounting rail, a first rail engaging surface and a second rail engaging surface, said first rail engaging surface and said second rail engaging surface facing said angulated lower side surface, when mounted on the rail, a third rail engaging surface and a fourth rail engaging surface, said third rail engaging surface and said fourth rail engaging surface facing said angulated upper side surface, when mounted on the rail, wherein at least said third rail engaging surface and said fourth rail engaging surface are formed with alternating flat surfaces and indentation surfaces, each indentation surface having a width extending a width of each of said transverse slots, and each flat surface having a width smaller than a width of each rail projection, and wherein said flat surfaces face said angulated upper side surfaces of the standard mounting rail while said indentation surfaces face said transverse slots there between.

2. A mounting assembly as claimed in claim 1, wherein said first rail engaging surface and said second rail engaging surface are formed with alternating flat surfaces and indentation surfaces, each indentation surface having a width extending a width of each of said transverse slots, and each flat surface having a width smaller than a width of each rail projection.

3. A mounting assembly as claimed in claim 1, wherein said mounting assembly comprises a fifth rail engaging surface, said fifth rail engaging surface facing a flat top surface mounting surface of said standard mounting rail, when mounted on the rail, and wherein said fifth rail engaging surface is formed with alternating flat surfaces and indentation surfaces, each indentation surface having a width extending a width of each of said transverse slots, and each flat surface having a width smaller than a width of each rail projection.

4. A mounting assembly as claimed in claim 1, wherein said indentation surfaces have a width extending a width of each of said transverse slots and being at least 6 mm.

5. A mounting assembly as claimed in claim 1, wherein said indentation surfaces have a depth of about 1.5 mm.

* * * * *